US006102577A

United States Patent [19]

Tremaine

[11] Patent Number: 6,102,577

[45] Date of Patent: Aug. 15, 2000

[54] ISOLATED OIL FEED

[75] Inventor: Eric Tremaine, Longueuil, Canada

[73] Assignee: Pratt & Whitney Canada Corp., Longueuil, Canada

[21] Appl. No.: 09/170,289

[22] Filed: Oct. 13, 1998

[51] Int. Cl.[7] ..... F01D 25/16

[52] U.S. Cl. ..... 384/493; 184/6.11; 184/6.22; 184/104.1; 415/112; 415/142; 415/136

[58] Field of Search ..... 384/99, 905, 581, 384/557, 493; 184/6.16, 11.2, 104.1, 6.11, 6.22; 415/111, 112, 142, 175, 134, 136; 785/217, 220, 221, 333

[56] References Cited

U.S. PATENT DOCUMENTS

| | | | |
|---|---|---|---|
| 1,751,448 | 3/1930 | Campell, Jr. | 285/219 |
| 3,312,448 | 4/1967 | Hull, Jr. et al. | 415/175 |
| 4,156,342 | 5/1979 | Korta et al. | 184/6.11 X |
| 4,234,197 | 11/1980 | Armancharla | 277/124 |
| 4,304,522 | 12/1981 | Newland | 415/142 X |
| 4,453,784 | 6/1984 | Kildea et al. | 184/6.11 X |
| 4,574,584 | 3/1986 | Hovan | 415/175 X |
| 4,770,444 | 9/1988 | Hauk | 285/333 X |
| 5,080,555 | 1/1992 | Kempinger | 415/142 |
| 5,137,310 | 8/1992 | Noel et al. | 285/333 |
| 5,160,251 | 11/1992 | Ciokajlo | 415/142 |
| 5,429,208 | 7/1995 | Largillier et al. | 184/6.11 |
| 5,489,190 | 2/1996 | Sullivan | 415/175 |

FOREIGN PATENT DOCUMENTS 4412314 10/1995 Germany .

*Primary Examiner*—David A. Bucci
*Assistant Examiner*—Brandon C. Stallman
*Attorney, Agent, or Firm*—Jeffrey W. Astle

[57] ABSTRACT

A bearing gallery thermal movement isolation device permits the inner bearing support ring of the bearing gallery to float freely relative to the outer bearing gallery housing under thermal expansion and contraction during engine operation without transmitting thermally induced movement or forces to the oil supply and scavenge lines, or to the cooling air supply line. An oil transfer tube isolation connector is disposed on an inward end of the transfer tube and on the bearing gallery. The connector includes a radially extending sleeve on the inner bearing support ring; and a sliding O-ring engaging the sleeve and transfer tube. An oil scavenge canal is defined between the O-ring and a threaded connection between the transfer tube and the oil supply boss of the bearing gallery. The oil scavenge canal intercepts any leakage of high pressure oil past the O-ring seal, recovers any such oil leakage within the low pressure oil scavenge circuit, and prevents high pressure oil leakage from the bearing gallery through the treaded connection.

9 Claims, 3 Drawing Sheets

9
1
10
22
15
28
27
30
7
16
29
11
31
3
8
8
27
6
13
2
4
5

ISOLATED OIL FEED

TECHNICAL FIELD

The invention is directed to a bearing gallery thermal movement isolation device that permits the inner bearing support ring of the gallery to float freely relative to the outer bearing housing under thermal expansion and contraction during gas turbine engine operation without transmitting thermally induced movement or forces upon the oil supply line rigidly fixed to the outer bearing housing and engine structure.

BACKGROUND OF THE ART

A gas turbine engine generally includes an engine structure mounting a shaft on oil lubricated bearings housed in a bearing gallery for rotation about an engine axis. The bearing lubrication circuit includes the bearing gallery sealed with running seals to the shaft, a lubricating oil supply line fixed to the bearing gallery and an oil scavenge line.

The oil supply line is in flow communication with an annular oil supply plenum in the bearing gallery; and the lubricating oil scavenge line is in flow communication with a bearing oil bath chamber in the bearing gallery. Oil pump, oil filter, oil heat exchanger and pressure regulator complete the bearing lubrication circuit. During operation of the gas turbine engine, the shaft mounted on the bearing rotates at extremely high speed and generates substantial heat energy in the immediate area of the bearings. To lubricate the bearings and prevent overheating, lubricating oil is pumped from outside the engine core through an oil supply line to the bearing gallery. Oil under pressure is supplied to an annular oil supply plenum in the bearing gallery. The oil supply plenum includes several oil injection openings or nozzles that spray relatively cool oil on the bearings in selected areas. The oil is then collected in an oil bath chamber and may be further circulated or splashed within the bearing gallery and oil bath chamber with oil scoops which splash oil over heated surfaces. The oil bath chamber is evacuated with an oil scavenge line that returns the heated oil to the oil pump, filter and heat exchanger for re-circulation.

Typically the oil is fed from the supply line at approximately 225° F. maximum and after circulating within the bearing area is scavenged at a temperature of approximately 355° F. maximum. The bearings and bearing chamber operate at approximately 375° F. maximum. The bearing gallery includes an air-filled cooling jacket supplied with cool compressed air from the compression section of the engine.

When the gas turbine engine is cool, the bearings may have a temperature equal to the ambient air temperature, for example, as low as −40° F. Therefore, it can be appreciated that the bearings and the bearing gallery experience substantial fluctuations in temperature between non-operating to operating condition.

The oil supply line is fixed into the bearing gallery in a threaded connection to form a rigid oil tight seal and prevent oil leakage into the engine. Due to the expansion and contraction of the inner bearing support ring of bearing gallery, the rigid connection with oil tube can cause significant stress and movement of the bearing gallery. Thermally induced movement of the bearing gallery results in leakage between the rotating shaft and the running seals mounted to the bearing gallery housing.

Therefore, it is desirable to provide a device to connect the oil tube and engine gallery in such a manner as to reduce or eliminate the transmission of thermally induced bearing gallery movement and accompanying stresses to the oil tube while also maintaining the liquid seal to prevent oil leakage into adjacent areas of the engine.

DISCLOSURE OF THE INVENTION

The invention is directed to a bearing gallery thermal movement isolation device that permits the inner bearing support ring of the bearing gallery to float freely relative to the outer bearing gallery housing under thermal expansion and contraction during engine operation without transmitting thermally induced movement or forces to the oil supply line.

A gas turbine engine generally includes an engine structure mounting a shaft on oil lubricated bearings housed in a bearing gallery for rotation about an engine axis. The bearing lubrication circuit includes the outer housing of the bearing gallery sealed with running seals to the shaft, a lubricating oil supply line and an oil scavenge line both fixed to the engine structure. The oil supply line is in flow communication with an annular oil supply plenum within the inner bearing support ring; and the lubricating oil scavenge line is in flow communication with a bearing oil bath chamber in the bearing gallery.

The inventive improvement relates to a bearing gallery thermal movement isolation device to allow the inner bearing support ring of the bearing gallery to float freely relative to the outer bearing gallery housing when expanding or contracting due to change in temperature during operation. The isolation device includes a radially extending oil transfer tube with an outward end connected to the oil supply line and including an inward shoulder fixed to the outer bearing gallery housing. An oil transfer tube isolation connector is disposed on an inward end of the transfer tube and on the bearing gallery. The connector includes a radially extending sleeve on the inner bearing support ring; and a sliding O-ring engaging the sleeve and transfer tube.

The inner bearing support ring and outer bearing gallery housing may be radially spaced apart with interconnecting ligaments to provide a thermal disconnect. Such ligaments bend or flex slightly as the hot inner ring expands relative to the cool outer housing. To ensure that this relative movement does not subject the oil supply line to stress, to preserve the oil seal and to prevent lateral movement of the bearing gallery, the sliding connection between the inner ring and the transfer tube is provided.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Figure 1:
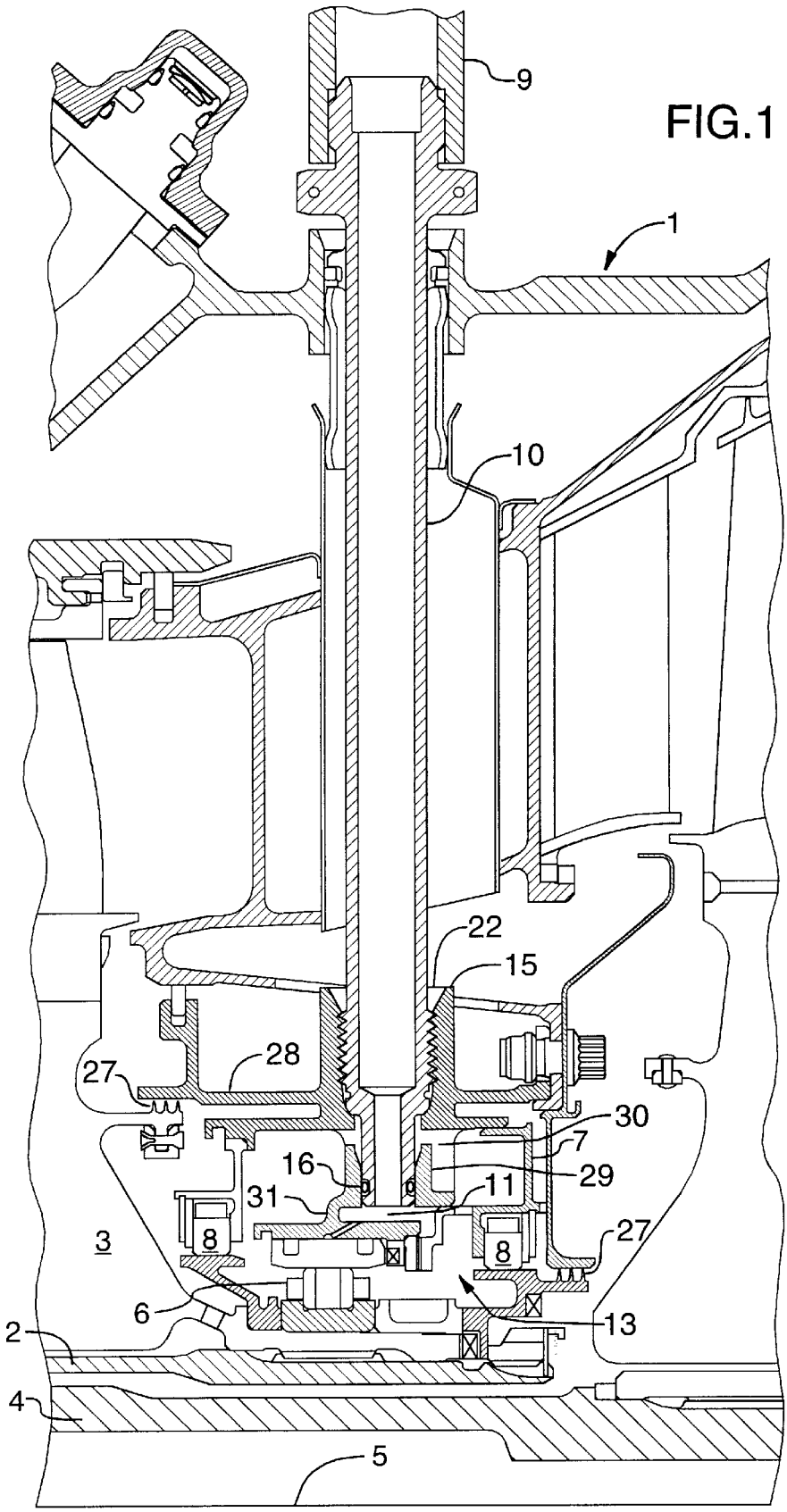
FIG. 1 is an axial cross-section through a bearing gallery with radially extending (upwardly as drawn) oil transfer tube that extends through the hot gas path between adjacent turbine rotors.

With reference to FIG. 1, a gas turbine engine generally includes an engine structure 1, which mounts a shaft 2 driven by turbine rotor 3. In the illustration shown a second shaft 4 is provided concentric to the axis of rotation 5. The shaft 2 is mounted on oil lubricated bearings 6 for rotation about the engine axis 5, within an oil sealed bearing gallery 7. The bearing gallery 7 is sealed with running seals 8 to the shaft 2. The bearing lubrication circuit of the engine includes a lubricating oil supply line 9 which is fixed to the engine structure 1 via the outward end of the oil transfer tube 10. The oil supply line 9 is in flow communication with an annular oil supply plenum 11 within the inner bearing support ring 31 of the bearing gallery 7.

Figure 3:
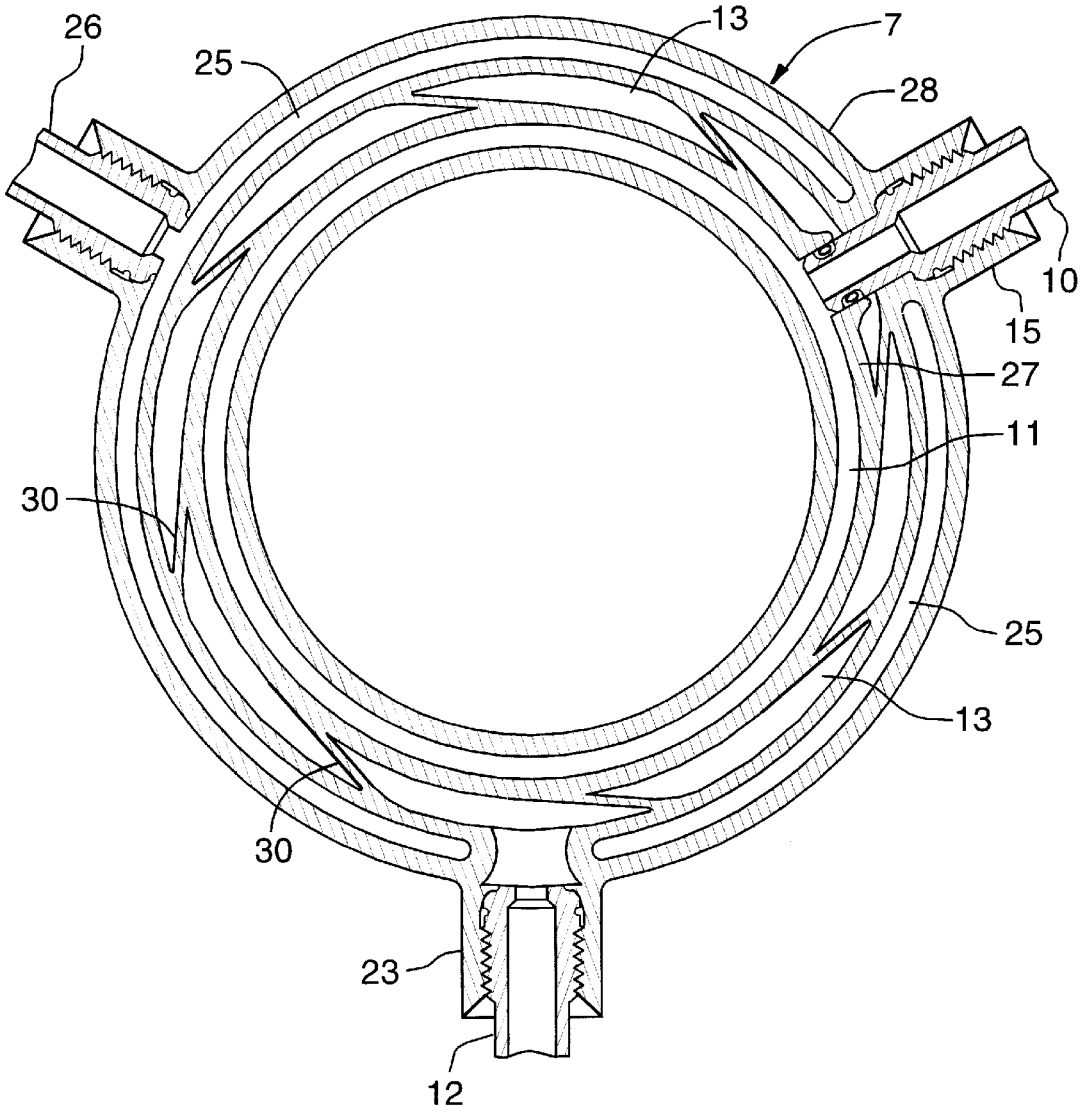
FIG. 3 is a radial sectional view through the inward end of the transfer tube and bearing gallery as indicated along lines 3—3 of FIG. 2.

FIG. 3 shows the radial cross-sectional view of the oil supply plenum 11 with inward end of the oil transfer tube 10 injecting pressurized lubricating oil in the annular plenum 11. A lubricating oil scavenge line (not shown) is fixed to the engine structure 1 in a threaded manner similar to the arrangement shown in FIG. 1. The oil scavenge line is flow communication with a bearing oil bath chamber 13 in the bearing gallery 7. As shown in FIG. 3, the bearing lubrication oil circuit includes a radially extending oil scavenge tube 12, which except for the most inward end portion is similar to the oil transfer tube 10 shown in detail in FIG. 1. The oil scavenge tube 12 has an outward end fixed to the oil scavenge line (not shown) and serves to return the oil (after accumulating heat from the bearings) back to a heat exchanger, oil pump and filter.

The improvement provided by the invention relates to a bearing gallery thermal movement isolation device which connects the inner bearing support ring 31 of the bearing gallery 7 to the oil transfer tube 10 such that thermal movement of the inner ring 31 does not move the outer bearing housing 28. By isolating the movement of the inner ring 31, the contact of the running seals 8 remains intact.

A sliding connector is provided which is sealed such that the inner ring 31 can expand and contract radially relative to the outer bearing housing 28 without transmitting radial movement or thermally induced stress to the tubes 10 and 12. In the described embodiment, the inner ring 31 and outer housing 28 are radially spaced apart and connected together with tangentially extending ligaments 30. Such ligaments 30 provide a thermal disconnect between these components and flex slightly to permit thermal expansion during operation. Other manners of providing a thermal disconnect and maintaining the relative spacing of the inner bearing support ring 31 and the outer housing 28 may be utilised.

As shown in FIG. 1, the oil transfer tube 10 has an outward end fixed to the oil supply line 9 and an inward end with a shoulder threaded into the oil supply boss 15 of the outer bearing housing 28 with interconnecting cone surfaces 32 providing a conical oil seal. As best shown in the detailed view of FIG. 2, a sliding O-ring 16 mounted on an inner tip of the transfer tube 10 engages a sleeve 29 in the inner ring 31 and seals the inward end of the transfer tube 10. It can be seen from the detail of FIG. 2 that relative radial movement between the oil transfer tube 10 and the sleeve 29 results of sliding of the O-ring 16 on a mating cylindrical face 17 of the sleeve 29. An oil tight seal is provided at all times regardless of the relative movement of the O-ring 16 and cylindrical face 17.

It will be understood that the pressure of oil within the oil transfer tube 10 and oil supply plenum 11 is relatively high enabling the oil to be ejected in a stream through the spray nozzles 19. Conventional wear and tear, high pressure and high temperature may eventually lead to some leakage past the O-ring 16.

Figure 2:
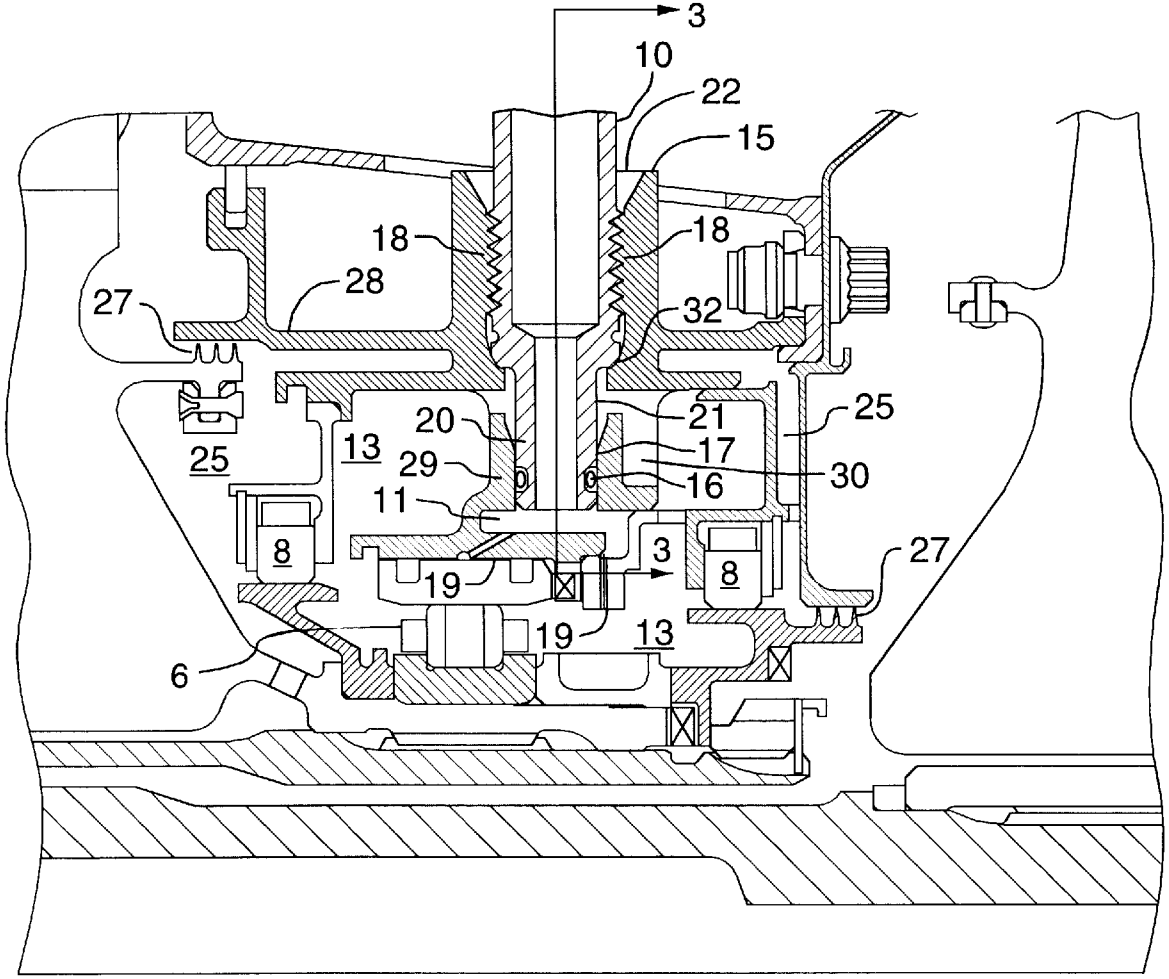
FIG. 2 is a detailed view of the oil gallery, bearings and oil transfer tube isolation connector.

As best shown in FIG. 2, the transfer tube 10 includes a mid-portion 20 disposed between the O-ring 16 and sleeve 29. To recover any oil leakage past the O-ring 16, the oil supply boss 15 includes a oil scavenge canal 21, which encircles the transfer tube mid-portion 20 and is in flow communication with the bearing oil bath chamber 13. As a result, any radially outward leakage (upward as drawn in FIG. 2) past the O-ring 16 will be collected and returned through the bearing oil bath chamber 13 via the scavenge canal 21.

It will be appreciated that without the oil scavenge canal 21, any leakage radially outward past the O-ring 16 would migrate between the outer surface of the oil transfer tube 10 and the inner surface of the oil supply boss 15. Such leakage could be ejected into the interior of the engine through the upper opening 22 of the oil supply boss 15. Therefore, to eliminate the possibility of contaminating of the interior of the engine with bearing lubricating oil, it is preferred to include a scavenge canal 21 to recover such oil leakage.

As stated above, the oil feed temperature is approximately 220° F. whereas the scavenge oil temperature is 355° F. serving to cool the bearing gallery which generally operates at a temperature of approximately 375° F. maximum. The oil transfer tube 10 is cooled by the supply of oil flowing inside the tube 10. The O-ring 16 therefore, is subjected to considerable stress and use of an inappropriate material would result in failure of the oil pressure seal. Conventional O-rings made of flourocarbon operate at a maximum temperature of approximately 400° F. Such O-rings are not suitable for this application since the bearing chamber operates at 375° F. and this arrangement would not provide adequate factor of safety. Accordingly, the O-ring is preferably made of a perflouroelastomer that can operate at a temperature of up to 700° F. One such O-ring is marketed under the trademark KALREZ by DuPont.

Turning to FIG. 3, the oil scavenge tube 12 has an outward end fixed to the oil scavenge line (not shown) and oil is thus returned from the oil bath chamber 13 to the bearing lubricating oil circuit. The scavenge tube 12 and the bearing gallery 7, are connected with a threaded connection and cone seal 32 as described with respect to the oil supply line.

As also shown in FIG. 3, the bearing gallery may include a cooling air chamber 25 provided with pressurized air through air supply tube 26 and as shown in FIG. 2 is permitted to escape through running air seals 27 to rejoin the cooling air system of the engine. The air supply tube 26 and the air supply boss of the bearing gallery 7 are connected with a threaded connection and conical seal surfaces 32 as well.

Although the above description and accompanying drawings relate to a specific preferred embodiment as presently contemplated by the inventor, it will be understood that the invention in its broad aspect includes mechanical and functional equivalents of the elements described and illustrated.

The embodiments of the invention in which an exclusive property or privilege is claimed are defined as follows:

1. In a gas turbine engine including an engine structure mounting a shaft on oil lubricated bearings housed in a bearing gallery for rotation about an engine axis, an outer housing of the bearing gallery sealed with running seals to the shaft, the engine including: a lubricating oil supply line fixed to the engine structure, the oil supply line in flow communication with an annular oil supply plenum within an inner bearing support ring of the bearing gallery; and a lubricating oil scavenge line fixed to the engine structure, the oil scavenge line in flow communication with a bearing oil bath chamber in the bearing gallery, the inner bearing support ring and outer bearing gallery housing being connected together with tangentially extending ligaments defining a thermal disconnect therebetween, the improvement comprising a bearing gallery thermal movement isolation device comprising:

a radially extending oil transfer tube with: an outward end connected to the oil supply line; and an inward shoulder fixed to a oil supply boss in the outer bearing gallery housing; and an oil transfer tube isolation connector, disposed on an inward end of the transfer tube and on the inner bearing support ring of the bearing gallery, the oil transfer tube isolation connector comprising: a radially extending sleeve on the inner ring of the bearing gallery; and a sliding O-ring engaging the sleeve and the inward end of the transfer tube, wherein the transfer tube includes a midportion disposed between the O-ring and the oil supply boss, and wherein the sleeve and oil supply boss are radially spaced apart defining an oil scavenge canal encircling the transfer tube midportion and in flow communication with the bearing oil bath chamber.

2. A device according to claim 1 wherein the inward shoulder of the oil transfer tube and oil supply boss in the outer bearing gallery have interconnecting threads defining a sealed joint.

3. A device according to claim 2 wherein the shoulder and oil supply boss inward of the threads include inter-engaging conical sealing surfaces.

4. A device according to claim 1 wherein the oil scavenge line communicates with an oil scavenge tube mounted in an oil scavenge boss in the bearing housing with interlocking threads.

5. A device according to claim 4 wherein the oil scavenge tube and scavenge boss include conical sealing surfaces inward of the threads.

6. A device according to claim 1 wherein the O-ring comprises a perfluoroelastomer.

7. A device according to claim 1 including a plurality of O-rings disposed on the transfer tube in sliding relation with the sleeve.

8. A device according to claim 1 wherein the bearing housing includes a cooling air chamber outward of the oil bath chamber, the cooling air chamber being in communication with a source of compressed air via an air supply tube mounted in an air supply boss in the bearing housing with interlocking threads.

9. A device according to claim 8 wherein the air supply tube and air supply boss include conical sealing surfaces inward of the threads.

* * * * *